United States Patent [19]

Richmeier

[11] Patent Number: 4,624,447

[45] Date of Patent: Nov. 25, 1986

[54] HYDRAULIC HIGH LIFT JACK

[76] Inventor: Thomas L. Richmeier, 330 Main St., Grainfield, Kans. 67737

[21] Appl. No.: 818,701

[22] Filed: Jan. 14, 1986

[51] Int. Cl.[4] ..... B66F 3/24

[52] U.S. Cl. ..... 254/93 H; 254/134

[58] Field of Search ..... 254/93 H, 133, 134, 254/100

[56] References Cited

U.S. PATENT DOCUMENTS

| | | | |
|---|---|---|---|
| 1,505,443 | 8/1924 | Stone | 254/134 |
| 2,010,679 | 8/1935 | Rosenberry et al. | 254/93 H |
| 2,476,838 | 7/1949 | Coffing | 254/133 R |
| 4,066,243 | 1/1978 | Johnson | 254/133 R |

*Primary Examiner*—Robert C. Watson

*Attorney, Agent, or Firm*—Thomas M. Scofield

[57] ABSTRACT

A variable and high lift jack powered by a hydraulic cylinder for lifting heavy work objects from close to the ground to high levels away from the ground, initial engagement being optionally low, intermediate and high; an adjustable, variable, low and high lift jack involving three basic adjustments, specifically: (1) a collar/platform on a vertical post, the latter carrying a hydraulic cylinder, (2) a slideable vertical sleeve on the same post vertically adjustable with respect to the top of the piston rod of the hydraulic cylinder by a chain carried between supports of the sleeve over the rod and (3) the variable vertical extendability and retractability of the piston rod of the hydraulic cylinder, the combination of these adjustments giving extraordinary versatility with respect to low to high adjustment of the work engaging beam of the lift device; a lift device of great power and versatility with a range, for example, from 6 to 44 inches in lift while maintaining the greatest safety of operation over the entire range of lift options.

16 Claims, 8 Drawing Figures

HYDRAULIC HIGH LIFT JACK

BACKGROUND OF THE INVENTION

High lift jack for raising (and supporting in a raised position) complex, large and heavy devices, machines and objects are well known to the art. The main point of every one of these devices is to provide a lift jack which can raise such objects over the widest possible range of height both securely and safely, as well as exceptionally dependably. Examples of uses of these devices are to raise and support (jack up and down) cars of various sizes, small trucks or pickups, trailers of various sorts, boat trailers, small campers, recreational vehicles, farm implements and the like.

Numerous objections to common high lift jacks are well known. Thus, many high lift jacks have quite a number of moving parts that readily tend to rust, thus impeding, preventing or threatening operation, dependabiilty and safety. Very often, the handle on a conventional high lift jack is too long to be used in certain restricted space circumstances. Many high lift jacks take most of an operator's body weight to use. Often, if the object is quite heavy, it takes two people to work the jack and lift the object.

Once a convenitonal high lift jack has been raised and the purpose carried out for which the object or vehicle was raised, the object must then be lowered to the original level or working conditions. Very often, when lowering an object, particularly heavier objects, devices or vehicles, the handle on the high lift jack gets totally out of control. Thus, the handle may swing or oscillate upwardly and downwardly at high speed, very possibly causing injury to the operator. There have been accidents and deaths caused by such devices. Finally, in the case of conventionally jacking or lifting certain particularly heavy objects, with a beam on the jack which is typically an I beam with holes punched centrally therethrough for successive engagement by the operating head of the jack, the beam itself may bend when the jack is raised to an uppermost or merely upper position.

Accordingly, substantial improvements are needed and required in the field of high lift jacks for operational effectiveness, efficiency, dependability, strength and safety to the operator. Such are some of the purposes of the subject high lift jack construction herein disclosed.

BRIEF DESCRIPTION OF THE INVENTION

The subject device is a variable and high lift jack or lifting device for such purposes as are mentioned in the previous section. In this device, there is provided a normally horizontal base plate to be placed or received on a ground or floor surface. A normally vertical shaft or post is rigidly fixed at its lower end to and on said base plate and extends upwardly normal thereto. This post is preferably rectangular (and most preferably square) in horizontal section for its entire height. The post has a number or plurality of equally vertically spaced apart, parallel to one another openings therethrough, said openings running vertically the entire or at least a substantial portion of the height of the post or shaft.

A base collar is slideably mounted on the post with the internal portion thereof enclosing the outer surface of the post being congruent to the latter, thus preferably rectangular or square. A set of opposed openings (one on each side of the collar, at least) through the collar are successively registerable with each of the post openings for fixing or pinning with respect to one thereof at a given time. The collar is internally configured so as not to rotate or oscillate to any significant degree on said post as it moves up and down same. The collar typically is used only with the bottom several of the post openings, typically two to four at the most.

A normally substantially horizontal platform is mounted on and carried by said base collar. This is typically accomplished by a yoke portion embracing and fixed to the sides of the collar having the openings therethrough whereby the yoke members also have such openings.

A hydraulic cylinder is fixably mounted on the platform and extends vertically upwardly therefrom substantially parallel to said main shaft or post and spaced away therefrom so that the operating parts of the hydraulic cylinder will not contact the post or shaft in operation. The hydraulic cylinder has a vertically extendable and retractable piston rod associated therewith, as well as the usual conventional means for infinitely variably extending and retracting said piston rod.

An upwardly arcuate chainway, normally enclosed on both sides thereof to retain a chain against slipping off therefrom, is rigidly fixed to the top of the hydraulic cylinder piston rod. The chainway extends substantially parallel to the axes of the sets of the openings in said post or shaft and preferably substantially normal to the extension of the yoke and/or platform supporting the hydraulic cylinder from said base collar. The ends of said chainway are preferably spaced apart a distance somewhat greater than the thickness of the hydraulic cylinder (which is typically cylindrical).

A preferably elongate lift slide is mounted on said post above said base collar and is vertically moveable or slideable thereon. Said slide is so internally configured that it will not rotate on said post. The post being preferably rectangular in horizontal section, the slide, both internally and externally, is preferably so configured. At least one set of opposed openings through the walls of said slide (next to the walls of the post carrying the openings therethrough) are provided registerable with the said openings in said post, sequentially, as the slide moves up or down the post. Preferably, there is a plurality of sets of openings provided through the wall of said slide, the openings vertically spaced apart a lesser distance than the vertical distance between the openings and the post. Most preferably the sets of openings through the walls of the slide are at least three or four in number and the distance between centers of the topmost and bottommost slide openings is equal to the distance between centers of the openings to said post.

A lift member is provided mounted on and fixed to said slide on a portion thereof spaced away from said hydraulic cylinder and also extending in a direction spaced away from said hydraulic cylinder. Most preferably, the lift member, hydraulic cylinder and the platform carrying the hydraulic cylinder are 180 degrees opposed to one another.

A bifurcated yoke is fixed at one end thereof to said slide and extends, in the divided portion thereof in a direction toward the hydraulic cylinder. Such two free end portions of the yoke extend substantially parallel to one another and under the chainway end portions.

On one of the yoke free end portions positioned outboard of said hydraulic cylinder there is provided a block or member which is fixedly engageable by one end of an elongate chain in pivotable fashion. Such chain is operable to connect the two yoke free end portions over the chainway. A hook member is fixed to the other yoke free end portion outboard of said hydraulic cylinder and is engageable with successive links in the remaining links of the chain at incremental positions therealong. The length of the chain is preferably at least substantially equal to twice the extendable length of the piston rod from the hydraulic cylinder.

Thus, a short chain linkage between the yoke free end portion connection means operates to relatively raise said slide with respect to the upper end of the piston rod. Longer and longer chain linkages between the yoke free end portion connections successively lower said slide with respect to the piston rod upper end.

The yoke fixed to said slide and engageable with the chainway by the said chain is preferably connected to an upper portion of said slide on the post. The lift member previously noted is preferably fixed to the slide on a lowermost or substantially lower portion than the yoke.

There is a first pin for removably engaging the base collar successively with said post opening. There is a second pin for removably engaging said sleeve with said post opening. A third pin may be provided for pinning the sleeve in its lowermost position with respect to the base collar and platform mounted on same when the chain is most shortly engaged and the device (collar and slide) is condensed at the base plate thereof for storage or transport.

OBJECTS OF THE INVENTION

The main object of the subject invention is to provide a hydraulic jack which can lift heavy devices over the widest possible range of heights effectively, securely and safely.

Another object of the invention is to provide a variable and high lift jack which has relatively few moving parts and very few of same that would tend to rust.

Yet another object of the invention is to provide a variable and high lift jack wherein the relatively short handle associated with the hydraulic cylinder enables the use of the jack in many limited space circumstances.

Still another object of the invention is to provide a variable and high lift jack which takes very little of an operator's body weight to use. Yet further, even if the object is very heavy, only one person is required to work the hydraulic cylinder of the jack and lift the object.

Yet another object of the invention is to provide an extraordinarily strong, rugged and durable variable and high lift hydraulic jack wherein, even when the jack is raised to its uppermost position, there is maximum strength and resistance to any bending whatsoever, particularly of the basic post or shaft of the jack.

Still another object of the invention is to provide an hydraulic high lift and variable lift jack wherein, when lowering an object, no matter how heavy the object lifted, the handle on the hydraulic cylinder will not get out of control or create a hazard.

Another object of the invention is to provide a variable and high lift jack wherein a plurality of means of height adjustment are available to provide an optimum mix of the positions of the various parts of the device for a given lifting situation. Thus, the base collar is vertically adjustable on the lower part of the jack shaft or post, there additionally being provided a chain support with respect to the slide on the jack post carrying the lifting member, the combination of chain support adjustment and collar height adjustment, as well as the controllable lift of the hydraulic cylinder, giving the greatest versatility with respect to height adjustment of the parts of the jack with respect to one another.

Another object of the invention is to provide such a variable lift and high lift jack which is extremely adjustable with respect to the optimum position of the jack parts for lifting a particular kind of vehicle, device or object, whereby to be able to maximize convenience and range of lifting, as well as safety and security to the operator and object being lifted.

Still another object of the invention is to provide a high lift and variable lift jack as described wherein the slide member carrying the lift member which engages the device, vehicle or object to be lifted has a multiplicity of closely spaced holes therethrough, such holes spaced in conformity with the distance between the holes on the main jack post or shaft, thereby to maximize safety in lifting by permitting pinning at small incremental positions of lift for safety's sake.

Other and further objects of the invention will appear in the course of the following description thereof.

THE DRAWINGS

STRUCTURE AND FUNCTION

Figure 1:
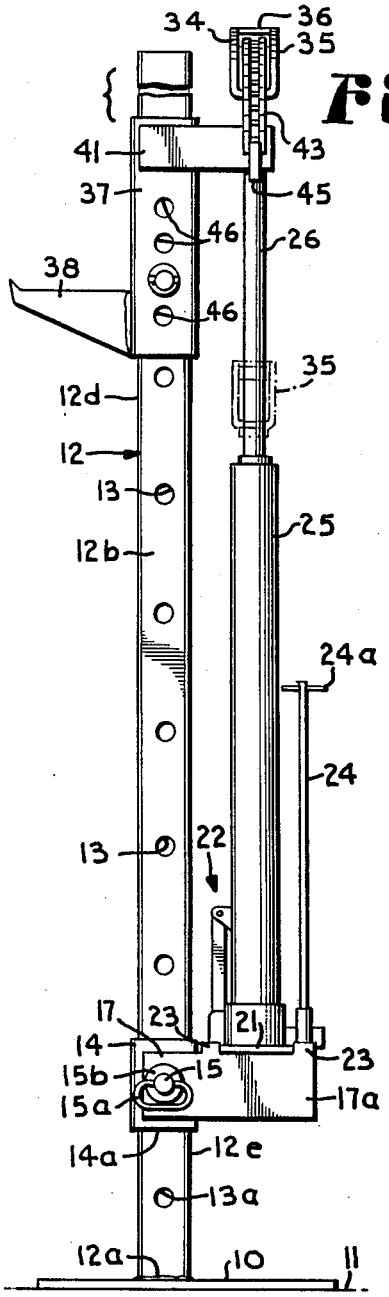
FIG. 1 is a side view of a first side of the subject jack wherein the base collar is engaged on the jack post above the lowermost engagement position and, additionally, the hydraulic cylinder piston rod is shown fully extended at a particular upper chain adjustment. The lower position of the top of the hydraulic piston is shown in dotted lines in the view.

Referring to the drawings, at 10 there is seen an elongate, rectangular base plate. This plate is mountable or receivable on a ground or floor surface 11 preferably in as near horizontal position as possible. Normally vertical beam, post or shaft 12 is fixed at its lower end 12*a* to the upper surface of base plate 10 and extends upwardly normal thereto. While post 12 may be cylindrical, oval, triangular or other shape in horizontal section, preferably it is rectangular in such section and most preferably square Post 12 may be a hollow beam or solid beam, but, like base plate 10 is preferably made of high grade steel of great strength. Post 12 has a plurality of openings 13 therethrough. Such openings are equally vertically spaced apart from one another, as well as parallel to one another. Openings 13 run vertically at least a substantial portion of the height of post 12 and preferably substantially entirely the height thereof. In the modification of the invention shown, openings 13 run from wall 12*b* to wall 12*c* of post 12.

Of the other walls of the square post or beam 12 illustrated, wall 12*d* is the front or forward wall (toward the work to be lifted), while wall 12*e* is the rear or rearward wall away from the work to be lifted.

A base collar 14 is provided which is slideably mounted on the post. It has a pair or set of opposed openings (not seen) therethrough preferably of the same size thereof and registerable with each of the post or beam openings 13, successively. Beam openings or passages 13 are all preferably the same size or diameter and are most preferably positioned on the central axes of the post 12 and sides 12*b* and 12*c*. Collar 14 is internally congruent with the exterior surface of post 12 and very slightly frictionally engaged (freely slideably) thereon. Collar 14 is preferably also externally congruent with post 12, but not necessarily so. An elongate pin 15, preferably having head handling loop 15*a* thereon, as well as head washer 15*b* fixed thereon, extends through the opposed openings (not seen) in collar 14 (and also the yoke beams 17 and 18 fixed thereto to be described) with free pin end 15*c* extending through the opposite post side 12*c*, the opposite yoke member 18 to be described as well as the opposite wall of collar 14. Hitch pin clip 16 removably engages an opening through pin 15 adjacent pin end 15*c* to releasably lock pin 15 with respect to openings through the members described.

Yoke members 17 and 18 embrace the side walls of collar 14 and are welded or otherwise fixedly attached thereto. Yoke members 17 and 18 extend rearwardly as parallel plate or beam members 17*a* and 18*a*. Normally vertical beam members 17*a* and 18*a* are provided with top wall 19 joining the top portions thereof and optional lower wall 20 joining the bottom portions thereof.

The former, top wall 19, serves to support the base 21 of hydraulic cylinder assembly 22 of conventional type. Tabs 23 from beams 17*a* and 18*a* overlie and fixedly attach base plate 21 of the hydraulic cylinder assembly 22 to top plate 19. However, the base 21 of the cylinder assembly may be otherwise attached thereto such as by welding or other means. An elongate vertical rod 24 is mounted on one of the tabs 23 for a purpose to be described.

The hydraulic cylinder assembly 22 is made up of entirely conventional parts, particularly including the cylinder 25 thereof, the vertically extendable and retractable piston rod 26, the pump mechanism generally designated 27, including pump rod 28 driven by up and down reciprocation of handle 29, the latter removably received at one end thereof in sleeve 30. The purpose of elongate rod 24, which has hitch pin clip 24*a* removably received in an opening adjacent the top thereof, is to receive and store hollow pump handle 29 when the device is out of use or in storage.

The hydraulic jack or cylinder illustrated is of conventional sort where, via reciprocation of handle 29, pump rod 28 pumps hydraulic fluid from a reservoir to a chamber under the base of the main piston 26 to raise same, with the main lift piston or rod 26 being returned to a lower position by return of hydraulic fluid to the reservoir.

Figure 4:
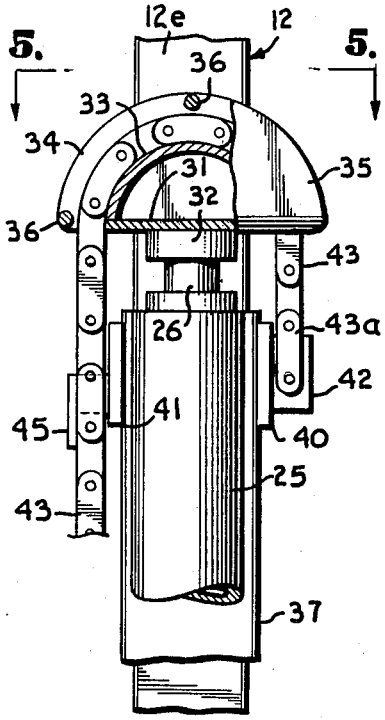
FIG. 4 is a fragmentary, enlarged, partly cut away view of the upper center of FIG. 3 detailing the top of the hydraulic cylinder, the top of the piston rod of the cylinder in its lowermost position and further illustrating the arcuate chainway and the chain position with respect thereto.
Figure 5:
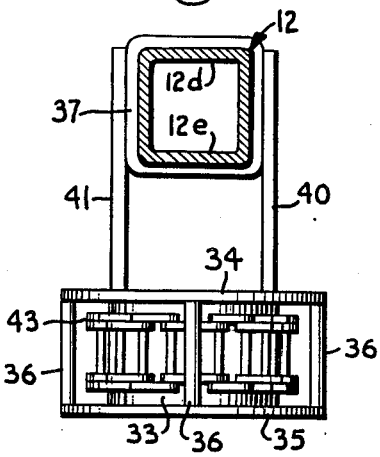
FIG. 5 is a view taken along the line 5—5 of FIG. 4 in the direction of the arrows.
Figure 6:
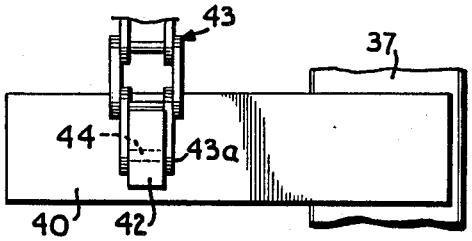
FIG. 6 is an enlarged detail of the yoke beam seen in the upper center of FIG. 2 just below the line 7—7 and showing the permanent engagement of one end of the chain with the block mounted on the yoke segment.
Figure 7:
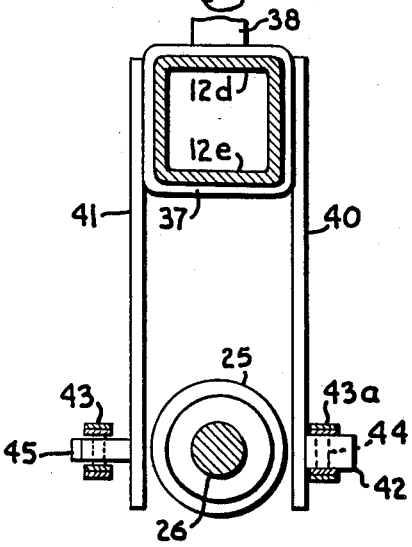
FIG. 7 is a view taken along the line 7—7 of FIG. 2 in the direction of the arrows.
Figure 8:
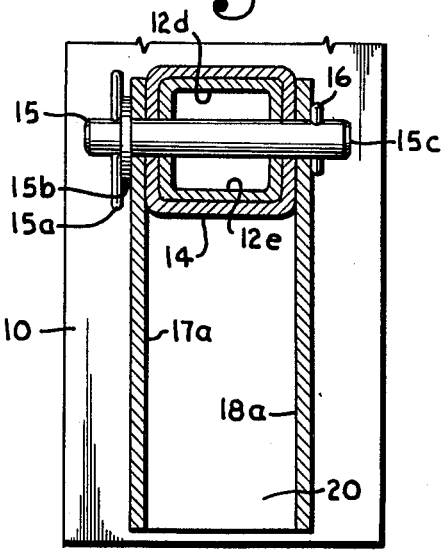
FIG. 8 is a view taken along the line 8—8 of FIG. 3 in the direction of the arrows.

Particularly referring to FIGS. 4 and 5, plate 31 is welded or otherwise fixedly attached to base 32. The latter is either provided on top of rod 26 or additionally added thereto in rigid, fixed fashion. Plate 31 has arcuate chainway 33 (upwardly arcuate) fixedly attached thereto and extending across the length thereof. Plate 31 is rectangular in form and it and chainway 33 run parallel to the axes of openings 13 and at right angles to walls 12*b* and 12*c* of post or beam 12. Front and rear walls 34 and 35, respectively, are formed integral with or rigidly attached to plate 31 at the front and rear edges thereof, extending upwardly normal thereto. Walls 34 and 35 may also be fixed to the front and rear edges of chainway 33 and are preferably fixed to one another by a plurality of rods or bars 36 adjacent the outer peripheries of walls 34 and 35.

Figure 3:
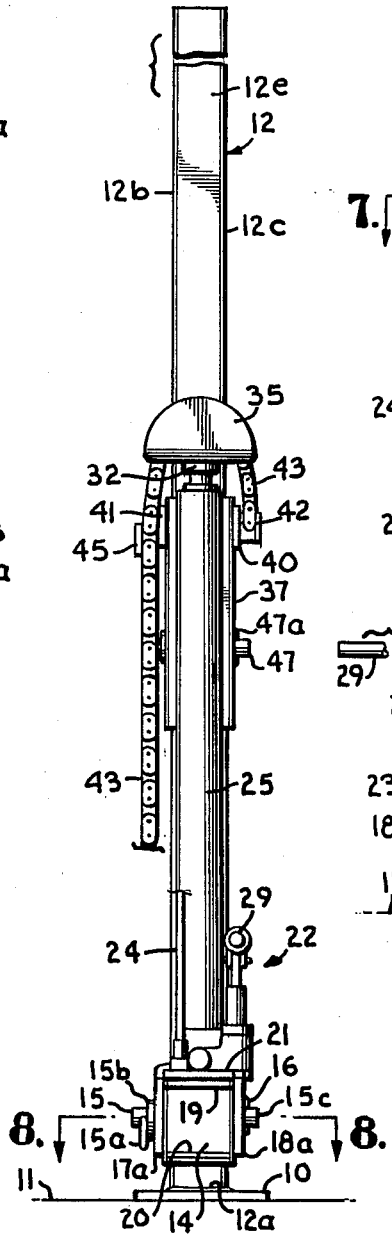
FIG. 3 is a rear view of the jack construction of FIGS. 1 and 2, being a view taken from the left in FIG. 2 looking to the right in that view.
Figure 2:
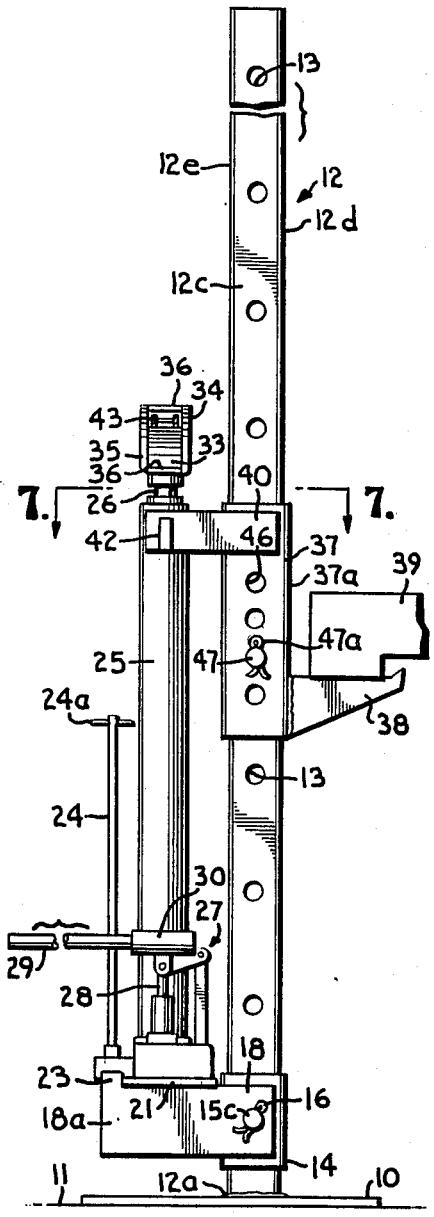
FIG. 2 is a view of the opposite side of the jack of FIG. 1 showing the base collar pinned in the lowermost jack post opening, the piston rod of the hydraulic cylinder being shown in its lowermost position and the chain adjustment still being at its shortest position.

Slideably mounted on posts 12 above collar 14 is elongate slide 37. Slide 37 is preferably internally congruent with the exterior of post 12, here square. The outside is not necessarily congruent with post 12 in horizontal section, but the slide 37 here illustrated is. The height of slide 37 is preferably at least equal to a distance slightly exceeding the distance between adjacent, vertically spaced holes 13 in post 12. In the instance hereshown, the height of slide 37 is somewhat greater than that. On the forward side of slide 37 there is positioned lift member 38. This is preferably centered on the forward side 37*a* of slide 37, serving to underlie, support and lift work 39 of various sorts, such as previously mentioned. At the top of the slide 37 illustrated, there are provided yoke members 40 and 41. These members are welded or otherwise fixedly attached to the side walls of slide 37 and extend horizontally (normal to slide 37, post 12 and collar 14) rearwardly past or under chainway 33, hydraulic cylinder 25 and piston rod 26. The distance apart of yoke members or beams 40 and 41 must be greater than the diameter or thickness of hydraulic cylinder 25 so that, as seen in FIGS. 2 and 3, they can slide downwardly past or next to the upper part of the side wall of cylinder 25.

Fixed to yoke beam 40 adjacent its rearward end and under chainway 33 is a perforated block 42 (FIGS. 2, 3, 4, 6 and 7). One end link 43*a* of a chain generally designated 43 is fixed to block 42 through opening 44 seen only in FIG. 6 and FIG. 7. Chain 43, which is preferably at least twice as long as the full length of extension of piston rod 26 passes over chainway 33 under rods or members 36 and usually extends down the other side of piston rod 26 and hydraulic cylinder 25, the latter particularly when rod 26 is retracted into cylinder 25 or the upper chain connection is short as will be described. On the other side of the hydraulic cylinder, in the views of FIGS. 3, 4 and 7, as well as FIG. 1, there is provided a hook member 45 which is removably engageable by any one of the links of chain 43 on the side of the chainway 33 opposite from connection 43*a*, 44.

In each of the views of FIGS. 1, 2, 3 and 4, the chain connection between members 38 and 41 is shown as the shortest or nearly the shortest possible. This means that the slide 37 is carried at the hightest point possible with respect to chainway 33 and the top of piston rod 26. As more chain is fed over the chainway 33 from hook 45 toward end connection 42, 44, slide 37 drops on post 12, whether the piston rod 26 is extended or not.

While slide 37 may, like collar 14, have but a single opening therethrough to be pinned into one of the posts or beam openings 13, most preferably, there are provided a plurality of openings 46 in the sidewalls of slide 37 with the top and bottom ones of the set being spaced apart, on centers, the distance between centers of two adjacent post openings 13. In the slide construction shown in the views, four such openings 46 are provided. Should the openings 13 be six inches apart on centers, with openings 46½ inches apart on centers, such enables the pinning of slide 37 with respect to post 12 every 1½ inches as the slide goes up or down post 12. This sort of control of locking the position of slide 37 close distances apart on post 12 is greatly conducive to safety for the operator in certain type of work and loads. It additionally enables precise control of positioning of slide 37 on post 12. Pin 47 is optimally of construction like pin 15 and has hitch pin clip 47*a* removably engageable with an opening in the end of pin 47 analogous to clip 16 and pin 15.

With respect to positioning the openings 13 on post 12, optionally, the bottommost opening 13*a* on post 12 may be so vertically positioned that the bottom edge 14*a* of collar 14 may actually rest on the top surface of base plate 10. Alternatively, opening 13*a* may be spaced upwardly somewhat from base 10 so that the initial pinned position of collar 14, as seen in FIGS. 2 and 3, has the bottom edge 14*a* of collar 14 spaced upwardly somewhat from the top surface of plate 10. Whichever is the case, the post 12 openings 13 are spaced equal distances upwardly from opening 13*a* and one another on the beam or post 12 so that the closely spaced openings 46 on slide 37 are equally spaced with respect to each set of openings 13. Additionally, this permits the insertion of two pins into the top and bottom openings 46 for engagement of two openings 13 in post 12 when necessary or desired.

In operation of the device of the figures, the following variables relate to the lifting or handling of any given device or work piece. First, there is the position of collar 14 vertically on post 12. Normally, collar 14 will not be spaced higher on post 12 then the third or fourth opening 13 from base plate 10. In order to keep the center of gravity as low as possible, it is desirable to keep collar 14 as low on post 12 as possible.

Secondly, there is the position of chain 43 with respect to connections 42 and 45. Each one of FIGS. 1, 2, 3 and 4 show a very short or the shortest chain length connection possible between block 42 and hook 45. This means that slide 37 is at its relatively highest position with respect to the top of piston rod 26. For example, particularly looking at FIGS. 2 and 3, with collar 14 in its lowermost engagement with post 12, pumping of piston rod 26 out of cylinder 25 the full length of the piston rod (a substantial portion of the length of cylinder 25) would give a very considerable lift of slide 37 on post 12. It might be noted that, in FIGS. 2 and 3, with collar 14 low and piston rod 46 not extended, a good portion of chain 43 would reach and be lying upon the floor or ground carrying plate 10 below hook 45. In the event that chain 43, with respect to FIGS. 2 and 3, were to be unhooked from hook 45 and slide 37 lowered on post 12 until it contacts the top of collar 14, the lengths of chain 43 on each side of the chainway 33 and cylinder 25 would be substantially equal in length. From this position, pumping of piston rod 26 out of cylinder 25 will raise the lift member 38 in equally efficient fashion to work at any other height on post 12, thus permitting an exceedingly low initial lift engagement for special kinds of work.

When slide 37 is employed from a starting position adjacent collar 14 with near equal chain extension on each side of cylinder 25, collar 14 may relatively safely be raised one or several openings on post 12 because of the relative maintenance of the low center of gravity and low working level.

The third variable with respect to the instant device and height of operation is the level of extension of piston rod 26. As previously described, the height of collar 14 on post 12 and relative height of sleeve 37 with respect to collar 14 may first be adjusted and then upward movement of piston rod 26 employed. Alternative combinations may be used. With the highest or a relatively high lift work situation, the slide 37 may be chain adjusted as high as possible with respect to the chain way 33 and piston rod 26, the collar 14 raised one or more openings on post 12 and then the piston rod 26 of cylinder 25 extended as far as necessary to do the work. Relative distances or heights with respect to this device naturally depend upon the height of the hydraulic cylinder employed and extendable distance of the piston rod 26. The same is true with respect to the absolute height of post 12, as well as the slide 37 length. FIG. 1 shows collar 14 pinned in the second opening 13 of post 12. The chain 43 holds yoke members 40 and 41 (and thus slide 37) as high as possible or relatively high with respect to piston rod 26. Finally, in the view, the rod 26 is near fully extended.

A specific example of the subject device utilizes a 1½ ton hydraulic jack. The device will lift from 6 inches to 44 inches in height. Initially, this device, with collar 14 fixed in bottom hole 13*a* will raise lift arm 38 to 33 inches in height. At which latter point a pin may be placed in the slide 37 opposite one of the higher openings. In this example, chain 43 is shortened to its minimum length between block 42 and hook 45 with respect to the head 28 of piston rod 26.

Retaining the chain engagement as described, if collar 14 is moved up to the third hole 13 on main beam 12, one is able to jack member 38 up to 44 inches.

In the event that the chain connection between block 42 and hook 45 is lengthened, thus dropping slide 37 with respect to the top of piston rod 26, intermediate levels of height are obtainable depending on the pinned height of collar 14 on post 12. When using the jack, it can be pinned every 1½ inches of lift (assuming openings 46 are 1½ inches apart on centers and openings 13 are 6 inches apart on centers) to insure safety to the operator. When the top and bottom holes 46 are opposite two openings 13, double pinning may be employed.

A first height adjustment is made possible by moving collar 14 carrying platform 19 mounting hydraulic cylinder 25 up and down on the main vertical post or shaft. However, unless slide 37 is adjusted downwardly with respect to the top of rod 26 by more equalizing the chain length engagement over chainway 33, collar 14 has limited vertical adjustment on the main post 12. This is because of the height of the hydraulic cylinder, per se and the additional length or height that can be obtained by upward adjustment or translation of the hydraulic piston rod.

This jack has two basic initial parameters of adjustment, both working on the vertical post 12. The first parameter of adjustment is the vertical postioning of collar 14 on the lower portion of post 12. The second parameter of adjustment is slide 37 (carrying lift member 38) on post 12 with respect to the chain engagement of block 42 and hook 45 over chainway 33.

Basically, the preferred operation involves first estimating the starting height of the lifting job or work, that is, the necessary initial contact of the upper surface of member 38 with the portion of the work object to be lifted. If this is relatively low, base collar 14 is keyed in base opening 13*a*. If the work object is quite low, slide 37 is lowered on post 12 by lengthening the chain portion 43 on the side of block 42. If the work object engagement is just slightly above the top position of member 38 in the pair of adjustments in FIGS. 2 and 3, then extension of piston rod 26 takes up the initial engagement. Alternatively, collar 14 may be lifted with sleeve 37 at its highest or a lower position.

If the work object engagement is relatively high, usually slide 37 will be positioned in its high position of FIGS. 1–4, inclusive and collar 14 raised one or more openings on post 12 to actual engagement or just short thereof so that extension of rod 26 can take up the initial engagement. Again, slide 37 may be lowered somewhat in this adjustment as may be required.

In a typical example of the subject device, using one standard hydraulic cylinder, the piston rod length is 18 inches, the piston cylinder height is 20½ inches and overall chain length 30 inches. Looking at FIG. 1, when slide 37 is raised and the chain hook end is in its substantially uppermost position, the chain length from the hook 45 to the end of the chain is 20 inches or some 5 inches below the top of the cylinder in the view. With the piston rod 26 retracted as in FIGS. 2 and 3, the chain would extend downwardly to ½ inch from the bottom of part or beam 17.

Plate 19 is preferably welded to the top edges of the member 17*a* and 18*a*.

Base 32 seen at top of piston rod 26 in FIGS. 3 and 4 is optional and the upper portion of piston rod 26 may be fixed directly to the underside of plate 31, extend therethrough and be welded or otherwise fixed thereto or the like. The base of hook 45 may be centered in the outer wall of member 41.

Cylinder 25, at its base, rests on plate 19, fitting between tabs 23. The latter are welded to plate 19. A bolt or bolts are provided through the cylinder base into or through plate 19 to secure the cylinder thereon.

In a typical example, the height of vertical post 12*b* may be 46½ inches with the height from base 10 (the top thereof) to the center of hole 13*a* being two inches. The clearance between the lower edge of collar 14 at 14*a* and the top of base 10 when pin 15 is engaged in hole 13*a* may be ½ inch. The height of the center of the single opening in collar 14 from the lower edge of collar 14 at 14*a* may be 1½ inches or more. The height of the top of base plate 19 above the bottom of collar 14 may be 2¾ inches. The full height of sliding sleeve 37 may be 10 inches and the length of arm or member 38 may be 4½ inches. The base of the chainway 33 may be ¾ inches above the top of sleeve 37 with the latter in topmost position.

For storage, collar 14 may be pinned through bottom hole 13*a* in beam 12. A second pin may be used to pin one of the openings 46 in sleeve 37 through one of the holes 13 in beam 12 when sleeve 37 is in its lowermost position. Alternatively, the second pin may be placed above sleeve 37.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A variable and high lift jack comprising, in combination:

a normally horizontal base plate receivable on a ground or floor surface, a normally vertical post fixed at its lower end on said base plate and extending upwardly normal thereto, said post having a plurality of equally vertically spaced apart, parallel openings therethrough, said openings running vertically a substantial portion of the height thereof, a base collar slideably mounted on said post and having a set of opposed openings therethrough registrable with each of the post openings for pinning with respect thereto, said collar configured so as to not rotate on said post, a normally substantially horizontal platform carried by said base collar, a hydraulic cylinder fixably mounted on said platform and extending vertically upwardly therefrom substantially parallel to said post and spaced away therefrom, said hydraulic cylinder having a vertically extendable and retractable piston rod associated therewith, an upwardly arcuate chainway enclosed on both sides thereof fixed to the top of said piston rod and extending substantially parallel to the axes of the openings in said post, the ends of said chainway spaced apart a distance greater than the thickness of said hydraulic cylinder, a lift slide mounted on said post and vertically moveable thereon, said slide so configured that it will not rotate on said post, at least one set of opposed openings through the wall of said slide registerable with the openings in said post, a lift member fixed to said slide on a portion thereof spaced away from said hydraulic cylinder and extending in a direction spaced away from said hydraulic cylinder, a bifurcated yoke fixed to said slide and extending in a direction substantially toward said hydraulic cylinder, the two free end portions of said yoke being substantially parallel to one another and extending under the said chainway end portions, a chain connecting the said yoke free end portions and extending over the chainway, one end of said chain fixedly connected to a first one of said yoke free end portions, a hook member fixed to the other yoke free end portion engageable with the remaining links in the remaining length of said chain at incremental positions therealong, whereby a short chain linkage between said yoke free end portion connections raises said slide with respect to the upper end of said piston rod and a longer chain linkage between same lowers said slide with respect to said piston rod upper end, a first pin for removably engaging said collar with said post openings and a second pin for removably engaging said sleeve with said post openings.

2. A jack as in claim 1 wherein said post is rectangular in horizontal section.

3. A device as in claim 1 wherein the length of said chain is at least substantially equal to twice the extendable length of said piston rod from said hydraulic cylinder.

4. A device as in claim 1 wherein end of said yoke connected to an upper portion of said slide and the lift member is connected to a lower portion of said slide.

5. A jack as in claim 1 wherein there are a plurality of sets of openings provided through the wall of said slide, said openings vertically spaced apart a lesser distance than the vertical distance between openings in the post, said sets of openings in said slide successively registerable with the openings in said post.

6. A device as in claim 5 wherein said sets of openings through the wall of said slide are at least three in number and the distance between centers of the topmost and bottommost slide openings is equal to the distance between centers of the openings through said post.

7. A variable and high lift jack comprising, in combination:

a normally horizontal base plate receivable on a ground or floor surface, a normally vertical post fixed at its lower end on said base plate and extending upwardly normal thereto, said post having a plurality of equally vertically spaced apart, parallel openings therethrough, said openings running vertically a substantial portion of the height thereof, a base collar slideably mounted on said post and having a set of opposed openings therethrough registerable with each of the post openings for pinning with respect thereto, said collar configured so as to not rotate on said post, a normally substantially horizontal platform carried by said base collar, a hydraulic cylinder fixedly mounted on said platform and extending vertically upwardly therefrom substantially parallel to said post and spaced away therefrom, said hydraulic cylinder having a vertically extendeable and retractable piston rod associated therewith, an upwardly arcuate chain way enclosed on both sides thereof fixed to the top of said piston rod and extending substantially parallel to the axes of the openings in said post, the ends of said chain way spaced apart a distance greater than the thickness of said hydraulic cylinder, an elongate slide mounted on said post and vertically moveable thereon, said slide so configured that it will not rotate on said post, at least one set of opposed openings through the wall of said slide registerable with the openings in said post in sequential fashion, a lift member fixed to said slide on a portion thereof substantially opposite to said hydraulic cylinder and extending outwardly from said post in a direction substantially opposite to said hydraulic cylinder, a bifurcated yoke fixed to said slide and extending in a direction substantially opposite to said lift member, as well as toward said hydraulic cylinder, the two free end portions of said yoke being substantially parallel to one another and extending under the said chain way end portions, a chain connecting the said yoke free end portions and extending over the chain way, one end of said chain fixably connected to a first one of said yoke free end portions, a hook member fixed to the other yoke free end portion being removably engageable with the remaining links in the remaining length of said chain at incremental positions therealong, whereby a short chain linkage between said yoke free end portion connections raises said slide with respect to the upper end of said piston rod and a longer chain linkage between same lowers said slide with respect to said piston rod upper end, a first pin for removably engaging said collar with said post openings and a second pin for removably engaging said sleeve with said post openings.

8. A jack as in claim 7 wherein said post is rectangular in horizontal section as are the portions of said sleeve and said collar engaging said post.

9. A device as in claim 7 wherein the length of said chain is at least substantially equal to twice the extendable length of said piston rod from said hydraulic cylinder.

10. A device as in claim 1 wherein the end of said yoke connected to said slide is connected to an upper portion thereof and the lift member is connected to a lower portion thereof.

11. A jack as in claim 7 wherein there are a plurality of sets of openings provided through the wall of said slide, said openings vertically spaced apart a lesser distance then the vertical distance between openings in the post, said sets of openings in said slide successively registerable with the openings in said post.

12. A device as in claim 11 wherein said sets of openings through the wall of said slide are at least three in number and the distance between the centers of the topmost and bottommost slide openings is equal to the distance between the centers of the openings through said post.

13. A device as in claim 12 wherein said sets of openings through the wall of said slide are four in number.

14. A device as in claim 7 wherein, when said collar is pinned through the lowermost opening on said post, the chain linkage between said yoke free end portion connections is as short as possible and the piston rod is fully extended from said hydraulic cylinder, the topmost portion of said slide is well below the top of the post.

15. A device as in claim 7 wherein, when the collar is pinned in the third opening from the bottom of the post, the chain linkage between the yoke free end portion connections is as short as possible and the piston rod is fully extended from the hydraulic cylinder, a substantial portion of the sleeve still remains on said post.

16. A device as in claim 7 wherein, when the slide lower end is resting on the collar upper end, and the collar is pinned in one of the post openings, a pin may be passed through a post hole or opening immediately above the collar, whereby to lock it into position for storage.

* * * * *